United States Patent [19]

Brown

[11] Patent Number: 4,735,063

[45] Date of Patent: Apr. 5, 1988

[54] SELF-CONTAINED COOLING DEVICE

[75] Inventor: Douglas E. Brown, Salt Lake City, Utah

[73] Assignee: Superior Marketing Research Corp., Salt Lake City, Utah

[21] Appl. No.: 37,554

[22] Filed: Apr. 13, 1987

[51] Int. Cl.[4] ..... F25D 3/00

[52] U.S. Cl. ..... 62/293; 62/294

[58] Field of Search ..... 62/293, 294, 384; 219/523

[56] References Cited

U.S. PATENT DOCUMENTS

| | | | |
|---|---|---|---|
| 1,437,481 | 12/1922 | Armstrong | 219/523 |
| 2,261,808 | 11/1941 | Morris | 62/293 X |
| 2,370,931 | 3/1945 | Bogin et al. | 62/293 |
| 2,591,375 | 4/1952 | Radford | 62/293 X |
| 2,746,265 | 5/1956 | Mills | 62/293 X |
| 2,805,554 | 9/1957 | Schachtsiek | 62/293 X |
| 3,067,589 | 12/1962 | Dennis et al. | 62/293 |
| 3,077,085 | 2/1963 | Johnston et al. | 62/293 |
| 3,830,239 | 8/1974 | Stumpf et al. | 62/294 X |
| 3,913,581 | 10/1975 | Ritson et al. | 62/293 X |

FOREIGN PATENT DOCUMENTS

| | | | |
|---|---|---|---|
| 141040 | 10/1930 | Switzerland | 62/293 |

*Primary Examiner*—William E. Tapolcai

*Attorney, Agent, or Firm*—Robert R. Mallinckrodt; Philip A. Mallinckrodt

[57] ABSTRACT

A self-contained cooling device for cooling the contents of an open container includes a cooling portion which, upon activation of the device, is cooled below ambient temperature and a handle portion secured to the cooling portion but insulated therefrom so that a user can grasp the handle portion and insert the cooling portion into the contents of an open container to be cooled and manipulate the cooling portion in such contents. In a preferred embodiment of the device, the device takes the form of an elongate rod similar to a stir stick which can be inserted into ad stirred about the contents of a container to be cooled.

4 Claims, 1 Drawing Sheet

SELF-CONTAINED COOLING DEVICE

BACKGROUND OF THE INVENTION

1. Field:

The invention is in the field of devices used to cool food or beverages, particularly for cooling individual portions of such food or beverage in an open container.

2. State of the Art:

Because of the custom of drinking mass quantites of cold liquids in our present society, great expense and effort is exerted in cooling and maintaining beverages in a cool state. In situations where it is impractical to carry modern refrigeration equipment, it is necessary to use ice, other similar materials, or instualted containers to maintain beverages in a cool state. However, ice and similar material only last for relatively short periods of time and must be continuously replenished. Similarly, insulated containers only maintain their contents cool for a similar relatively short period. In many instances when a cold beverage is desired, if an already cold beverage is not on hand and it is not desired to dilute the beverage by the addition of ice cubes, it is impractical to chill a warm beverage for immediate consumption because normal refrigeration units or so-called "ice chests" require time to permit the convection cooling process to fully chill the beverage to a suitable temperature. This is also true for other types of foods which require chilling prior to eating. It would thus be desirable to have a device that could be inserted into a beverage or other food within an open container and that could rapidly chill the container contents when desired without the need for external refrigeration units or "ice chests".

Various attempts have been made to provide a cooling device within a food container that can be activated when it is desired to cool the contents of the container. Such devices have generally used an expanding gas or a chemical reaction to provide the required cooling. These devices, however, are built into the food container, adding expense to the container, and are not usable for the cooling food or a beverage is such food or beverage is not on hand in such a container. An example of such a container is shown in pending application for U.S. Pat. No. 881,386 which has been assigned to the same assignee as the present application.

The need remains for a device that is easily portable, that can be actuated at any time cooling of a food or beverage is desired, and does not require a special container for such food or beverage.

SUMMARY OF THE INVENTION

According to the invention, a device for cooling the contents of an open container includes a cooling portion which is cooled to below ambient temperatrue upon activation of the device and a handle portion secured to but insulated from the cooling portion by which the device can be held and manipulated by a user so that the cooling portion of the device is brought into contact with and moved through the contents of the container to thereby cool such contents.

In many instances, the cooling portion of the device will become very cold when the device is operated, with the exterior surface of the cooling portion of the device reaching temperatures well below freezing. When using such device, it is preferred that a protective cover or guard be positioned over the cooling portion of the device. The cover surrounds the cooling portion but is spaced therefrom and has openings therethrough so that the contents of a container to be cooled can flow through the openings and contact the cooling portion of the device as the device is moved through the container, but so that the user is prevented during normal use of the device from direct contact with the cooling portion.

A preferred form of device for cooling the contents of an open container includes reservoir means and pressurized fluid within the reservoir means. The reservoir means forms the cooling portion of the device. Insulated handle means is secured to the reservoir and extends outwardly therefrom to provide an expansion chamber within the handle means and to provide a means for grasping the device so that the reservoir may be inserted into and manipulated within the contents of the container to be cooled. Normally closed passage means is provided between the reservoir and the expansion chamber along with means operable from outside the handle means for opening the passage means to allow the escape and expansion of pressurized fluid from the reservoir into the expansion chamber and then to the atmosphere when it is desired to activate the device. The expansion of the fluid from the reservoir cools the reservoir and by inserting the reservoir into the contents of the container to be cooled and by moving the reservoir around to stir the contents, the contents may be effectively cooled.

In one embodiment of the invention, the device is in the form of an elongate rod with handle at one end. Upon activation of the device, the device, except for the insulated handle gets cold. By holding the device by the handle and inserting it into the contents of the container to be cooled and manipulating it in the same manner as a stir stick to mix the contents of the container, the contents of the container is cooled. In this form of the device, a perforated protective cover can be secured to the device to extend from the handle down and surround the cooling portion of the rod. The cover prevents a user from directly touching the cooling portion of the rod, but is spaced from the cooling portion to still allow circulation of the contents of the container directly about the rod.

The passage means from the reservoir through the expansion chamber may take the form of a tube extending from the interior of the reservoir through the expansion chamber and out through an opening in the handle between the expansion chamber and the atmosphere. The tube is configured in a curve within the expansion chamber, has a weakened portion within the expansion chamber, and has a pull tab secured to its end outside the expansion chamber so that a user can pull the pull tab to thereby break the tube within the expansion chamber to activate the device.

THE DRAWINGS

In the accompanying drawings, which illustrate the best mode presently contemplated for carrying out the invention:

FIG. 1 is a side elevation of a cooling device of the invention;

FIG. 2, a vertical section of the device shown in FIG. 1;

FIG. 3, a side elevation of a cooling device similar to FIG. 1 but showing a protective cover over the cooling portion of the device;

FIG. 4, a figure similar to FIG. 3, but showing the protective cover in vertical section; and FIG. 5, a side elevation of a glass container showing the device of the invention in cooling position therein.

DETAILED DESCRIPTION OF THE ILLUSTRATED EMBODIMENT

Figure 2:
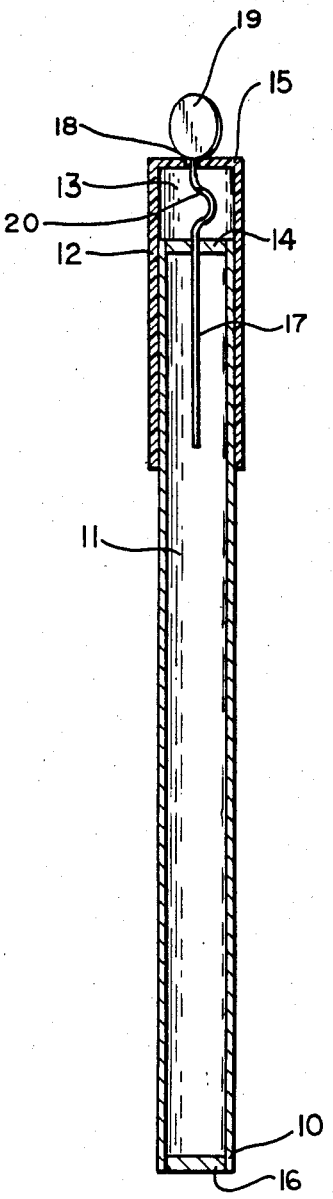
Figure 1:
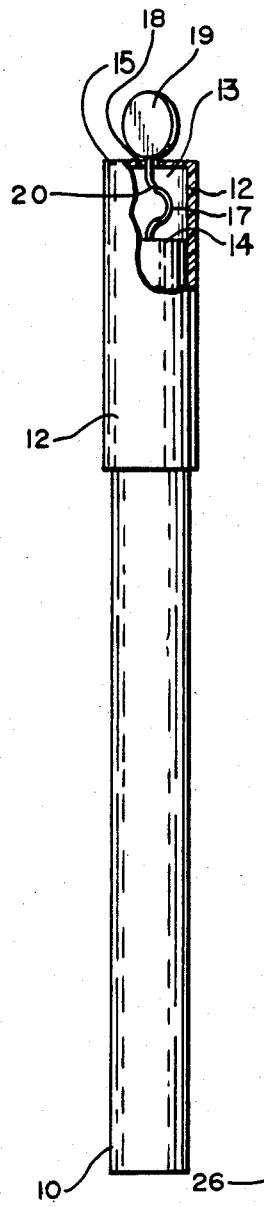

As shown in the drawings, a preferred embodiment of the invention has an elongate, tubular member 10 forming a reservoir 11 therein with an insulated handle 12 secured to the top portion of member 10, and extending therefrom to form an expansion chamber 13 between the top 14 of the reservoir 10 and the end 15 of handle 12. The side walls and bottom of member 10 may be formed as a single piece, or side walls 10 may be formed by a tube with separate bottom piece 16 and top piece 14, FIG. 2, secured to the respective ends of tubular side walls 10 such as by welding. Aluminum tubing of 0.005 inch wall thickness has been found satisfactory for tubing 10, although other material of high heat conductivity may be used. The tubing 10 forms the cooling portion of the device. Handle portion 12 will preferably be molded of a plastic material with good heat insulating properties so that it will not cool as rapidly as tubing 10 when the device is operated and will remain at a temperature comfortable for a user to grasp in his hand. Handle 12 may be sized so that it can be slid onto the end of tube 10 and held in place by a friction fit or may be glued in place on tube 10.

As indicated, tubing 10 forms a reservoir 11. A tube 17 extends through reservoir top 14 and out through opening 18 in top 15 of handle 12 where it is connected to a tab 19. Tube 17 is sealed at its end where connected to tab 19, such as by welding, and is secured in reservoir top 14 so as to form an air tight seal. Reservoir ends 14 and 16 also form an air tight seal so that reservoir 11 is air tight. The reservoir is filled with a refrigerant fluid which is under pressure at normal room temperature and which vaporizes under atmospheric pressure at a temperature no higher than the temperature to which it is desired to cool material in the container, and preferably significantly below this desired temperature. Various refrigerant fluids may be used with a preferred fluid being carbon dioxide.

The reservoir may be pressurized in various ways. For example, the reservoir may be completely assembled but the end of tube 17 left open. Liquid carbon dioxide may then be pumped under pressure into reservoir 10 through tube 17. Alternatively, the reservoir can be assembled with end 14 and tube 17 in place, but with end 16 open and tube 17 open. The bottom of tube 10 is connected to a source of liquid carbon dioxide and tube 10, in upright postion is filled until carbon dioxide flows from tube 17. At this point the end of tube 17 is sealed and then end 16 is sealed to tube 10 to form the air tight compartment. In this manner, the extent of filling of reservoir 11 is controlled by the extent to which tube 17 extends into reservoir 11. This is because with tube 10 in vertical position, when the liquid carbon dioxide reaches the bottom of tube 17, it will flow out of the top of tube 17 without substantially filling above the bottom of tube 17 because the top of reservoir 12 will become pressurized. Rather than liquid carbon dioxide being used to fill reservoir 11, a molded piece of solid carbon dixide, "dry ice", may be inserted into reservoir 11 with end 16 open and then end 16 secured in place.

It has been found that with liquid carbon dioxide, for satisfactory operation of the device and to maintain the pressure inside the reservoir within safe limits, the reservoir should be filled to about 60% of its volume. Thus, tube 17 is positioned to extend into the reservoir a distance such that when the reservoir has been filled to about 60% of its volume with liquid carbon dioxide, the liquid will flow out of tube 27 indicating sufficient filling and preventing substantial overfilling.

Once filled with liquid refrigerant and sealed, the refrigerant will boil in the reservoir until it reaches an equilibrium pressure for the particular ambient temperature of the reservoir. If the temperature is below 87° F. and the fluid is carbon dioxide, the fluid will generally be partially in a gaseous state and partially in a liquid state. Above about 87° F., the carbon dioxide will generally be in an all gaseous state.

Tube 17 extending from reservoir 11 through expansion chamber 13 and through opening 18 in handle top 15 to attachement to tab 19 is preferably of small diameter and may be referred to as a capillary tube. Thin walled copper tubing of an inside diameter of between about 0.0012 to 0.005 inch has been found satisfactory, although other materials may be used.

Tube 17 is crimped or scored at 20 to form a weakened portion of the tube as it passes through the expansion chamber 13 and is bent into a configuration in the expansion chamber so that if tab 19 is pulled, pushed, or twisted, the tube 17 is broken at crimp 20 so that the tube communicates between the fluid reservoir and the expansion chamber and pressurized fluid can escape through the tube from the reservoir into the expansion chamber. The bend in tube 17 is also such that preferably, once the tube is broken, the escaping pressurized fluid will be directed toward the wall of the expansion chamber rather than directly out through opening 18. The size of capillary tube 17 will determine the rate at which the pressurized fluid can escape from the reservoir. Opening 18 is large enough to allow tube 17 to pass therethrough and to be pulled by tab 19 in a manner to break the tube, and also to allow gas to easily escape from the expansion chamber without building up pressure within the chamber.

With the cooling device as described, when it is desired to operate the device, tab 19 is pushed or pulled to break tube 17 within expansion chamber 13. Tab 19 and the end of tube 17 attached thereto may then be removed and discarded. With tube 17 broken, reservoir 11 is opened to the atmosphere through tube 17 and pressurized fluid from reservoir 11 escapes to the atmosphere.

Figure 5:
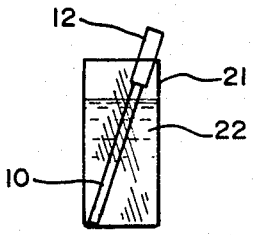

As the gas expands into the expansion chamber it absorbs heat and causes the tube 17 and the reservoir walls to cool. This in turn causes cooling of the contents of the reservoir. Continued expansion of fluid through the tube, causes continued cooling and as gas escapes from the reservoir, the pressure is reduced and any liquid in the reservoir will boil, absorbing heat from and further cooling the walls of the reservoir. If no liquid is initially present in the reservoir the initial cooling will generally cause liquid to form. After a suitable cooling time has elasped (approximately one to two minutes) or otherwise after all of the refrigerant has been released into the expansion chamber and been exhausted through opening 18, the cooling action stops. Generally, upon breaking tube 17 to begin the cooling action of the device, the device will be immediately placed in a container such as glass 21, FIG. 5, with material 22 therein to be cooled. The user will generally hold the device by handle 12 during the cooling process and move it around in glass 21 to maximize the cooling process and prevent substantial build up of contents on the device caused by freezing of the contents to the cooling portion of the device. The expansion chamber 13 shields the user from the direct stream of pressurized gas and the expanded gas flows harmlessly out through opening 18 to the atmosphere. The smallest inside diameter of tube 17 determines the flow rate of fluid from the reservoir and for a given volume of fluid in the reservoir, substantially determines the time during which fluid flows from the reservoir and during which cooling of the device takes place.

Figure 4:
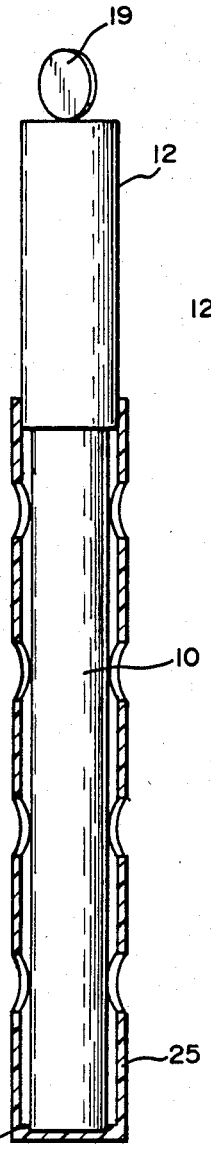
Figure 3:
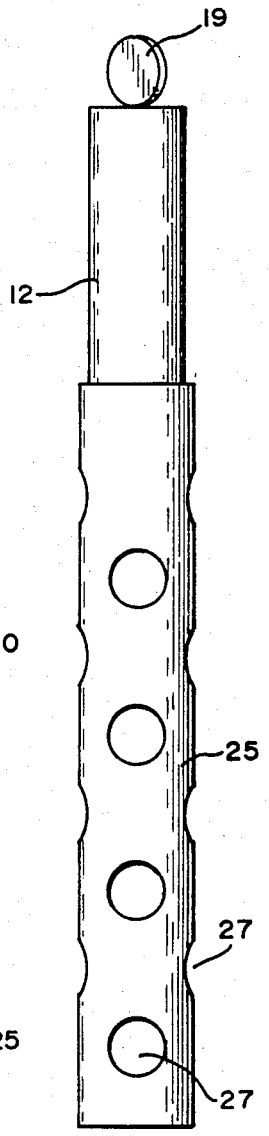

Since during operation of the device the cooling portion 10 of the device gets very cold, well below freezing temperature in most cases, it is preferred that the cooling portion of the device have a protective cover or guard surrounding it so that the cooling portion cannot be directly contacted by the user during normal handing or playing with the device. As shown in FIGS. 3 and 4, an insulating plastic material is formed into a protective sleeve or cover 25 which completely surrounds cooling portion 10 of the device. The cover is secured to the base of handle portion 12 such as by glueing and is spaced from cooling portion 10 throughout its length. The bottom of cooling portion 10 fits into a recess 26 at the bottom of cover 25 to further secure cover 25 in position. A plurality of openings or holes 27 through cover 25 allow any material to be cooled to flow through such holes and in and around cooling portion 10 to thereby be cooled. The cover, as shown, has been found to be a good safety measure and does not affect the cooling effectiveness of the device.

When in the shape of a stir stick, as shown, it has been found that a reservoir of about one-half inch outside diameter by about six inches in length and with carbon dioxide used as the refrigerant fluid, can cool about twelve ounces of liquid by about 30° F. to 40° F. The plastic handle is about two inches in length. With such dimensions, the device may be easily placed through the standard hole in the top of an open beverage can and cool the contents of the can within the can. Of course, the sizes of the various parts of the device and the relative shapes may vary considerably.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

What is claimed is:

1. A self-contained cooling device adapted to be actuated and placed in an open container to cool the contents of such container, comprising means forming a reservoir; pressurized fluid within said reservoir; insulated handle means secured to said reservoir and extending outwardly therefrom forming an expansion chamber within said handle means adjacent the reservoir, said handle means allowing for the insertion and manipulation of the reservoir within the contents of the container; passage means communicating with the inside of the reservoir and extending into the expansion chamber, said passage means being normally closed to prevent escape of pressurized fluid from the reservoir; and means operable from outside the handle for opening the passage means to allow the escape and expansion of pressurized fluid from the reservoir into the expansion chamber and then to the atmosphere when it is desired to cool the contents of the container.

2. A self-contained cooling device according to claim 1, wherein the reservoir is in the form of a hollow elongate rod.

3. A self-contained cooling device according to claim 1, wherein there is additionally provided a protective cover for the cooling portion of the device surrounding but spaced from the cooling portion and having openings therein to allow the contents of a container to be cooled to flow into contact with the cooling portion of the device but to substantially prevent direct contact of the cooling portion of the device with the user.

4. A self-contained cooling device according to claim 3, wherein the cooling portion of the device is in the form of an elongate rod and the protective covering is a perforate plastic sleeve that fits over the cooling portion.

* * * * *